US009759470B2

(12) United States Patent
Zisholtz et al.

(10) Patent No.: US 9,759,470 B2
(45) Date of Patent: Sep. 12, 2017

(54) METHOD AND APPARATUS FOR INSTANT ICE MAKING

(71) Applicant: Sweet Ice, Inc., Mineola, NY (US)

(72) Inventors: Evan Zisholtz, New York, NY (US); Steven Hamblin, Daleville, VA (US); Tod Riggan, Fincastle, VA (US)

(73) Assignee: SWEET ICE, INC., Mineola, NY (US)

( * ) Notice: Subject to any disclaimer, the term of this patent is extended or adjusted under 35 U.S.C. 154(b) by 645 days.

(21) Appl. No.: 14/246,550

(22) Filed: Apr. 7, 2014

(65) Prior Publication Data

US 2015/0040587 A1 Feb. 12, 2015

Related U.S. Application Data

(60) Provisional application No. 61/863,891, filed on Aug. 8, 2013.

(51) Int. Cl.
*F25C 1/04* (2006.01)
*F25C 5/00* (2006.01)

(52) U.S. Cl.
CPC ..... *F25C 1/04* (2013.01); *F25C 5/002* (2013.01); *F25C 2700/12* (2013.01); *F25D 2400/12* (2013.01); *F25D 2400/30* (2013.01); *F25D 2500/02* (2013.01)

(58) Field of Classification Search
CPC ..... F25D 2400/30; F25C 1/04
See application file for complete search history.

(56) References Cited

U.S. PATENT DOCUMENTS

| | | | | |
|---|---|---|---|---|
| 3,226,944 | A * | 1/1966 | Connors | F25C 1/04 62/137 |
| 3,796,063 | A * | 3/1974 | Wulke | F25C 1/04 62/340 |
| 6,651,448 | B2 * | 11/2003 | Ross | A23G 9/16 62/342 |
| 7,428,824 | B1 | 9/2008 | Malachowsky et al. | |
| 7,861,551 | B2 | 1/2011 | Hortin | |
| 2004/0025527 | A1 * | 2/2004 | Takahashi | F25C 1/18 62/340 |
| 2009/0249814 | A1 * | 10/2009 | Hausmann | F25C 1/225 62/318 |
| 2012/0277906 | A1 | 11/2012 | Fassberg et al. | |

* cited by examiner

*Primary Examiner* — Cassey D Bauer
(74) *Attorney, Agent, or Firm* — Leason Ellis LLP

(57) ABSTRACT

A portable apparatus for rapidly freezing a freezable liquid to form at least one frozen object includes a fluid intake in which the freezable liquid is introduced and a freeze chamber that receives the freezable liquid from the fluid intake. The freeze chamber includes a freeze block that includes at least one cell in which the at least one frozen object is formed. A cooling system circulates refrigerant to the freeze block to facilitate cooling of the freeze block. The freeze block is formed of a heat transfer material such that heat from the freezable liquid added to the at least one cell is transferred to the freeze block whereupon said heat is transferred to the refrigerant flowing through the evaporator coil of the freeze block, thereby resulting in cooling of the freeze block. The freeze block is configured and the refrigerant is selected such that the freeze chamber is maintained at a temperature of below 0° F. and preferably below at least about −10.0° F. or −20° F.

18 Claims, 13 Drawing Sheets

METHOD AND APPARATUS FOR INSTANT ICE MAKING

CROSS-REFERENCE TO RELATED APPLICATION

The present application claims priority to U.S. patent application Ser. No. 61/863,891, filed Aug. 8, 2013, which is hereby incorporated by reference in its entirety.

TECHNICAL FIELD

The present invention is generally directed to an ice making machine and more particularly, relates to a method and apparatus for making instant ice (e.g., ice cubes) from freezable liquids including flavored freezable liquids.

BACKGROUND

Current technology generally is limited to creating ice from water and takes significant time to freeze liquid into ice cubes. Moreover, ice made from water keeps beverages cold, but dilutes the drink and alters its taste. Freezing liquids individually in the freezer to have ice made of the liquid of your choice is time consuming and inconvenient. Reusable ice cubes keep beverages cold and do not dilute the drink, but they are also inconvenient because they: take too much time to freeze, must be accessible, are easily lost, and must be washed after each use.

The apparatus of the present application seeks to provide a solution to one or more of these problems by: (i) providing a "quick-freeze" technology whereby freezable liquid can be frozen within a short duration of time, and (ii) packaging the quick freeze technology into an apparatus providing a commercial or consumer product that will quickly convert freezable liquid into ice cubes. The quick freeze technology and apparatus can provide a quick, convenient and easy method for cooling a beverage and provide a mechanism to prevent the potential dilutive effect on a beverage that results from inserting standard water ice cubes into a flavored beverage.

SUMMARY

A portable apparatus for rapidly freezing a freezable liquid to form at least one frozen object (e.g., ice cubes) includes a fluid intake in which the freezable liquid is introduced and a freeze chamber that receives the freezable liquid from the fluid intake. The freeze chamber includes a freeze block that includes at least one cell in which the at least one frozen object is formed. A cooling system circulates refrigerant to the freeze block to facilitate cooling of the freeze block. The freeze block is formed of a heat transfer material such that heat from the freezable liquid added to the at least one cell is transferred to the freeze block whereupon said heat is transferred to the refrigerant flowing through the evaporator coil of the freeze block, thereby resulting in cooling of the freeze block. The freeze block is configured and the refrigerant is selected such that the freeze chamber is maintained at a temperature of below 0° F. and preferably below −10° F. (e.g., −20° F. or below and can be down to −50° F.). In general, the freeze block must be maintained below the freezing point (temperature) of the freezable liquid that is placed in the cell (well).

BRIEF DESCRIPTION OF THE DRAWING FIGURES

DETAILED DESCRIPTION OF CERTAIN EMBODIMENTS

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

Figure 1:
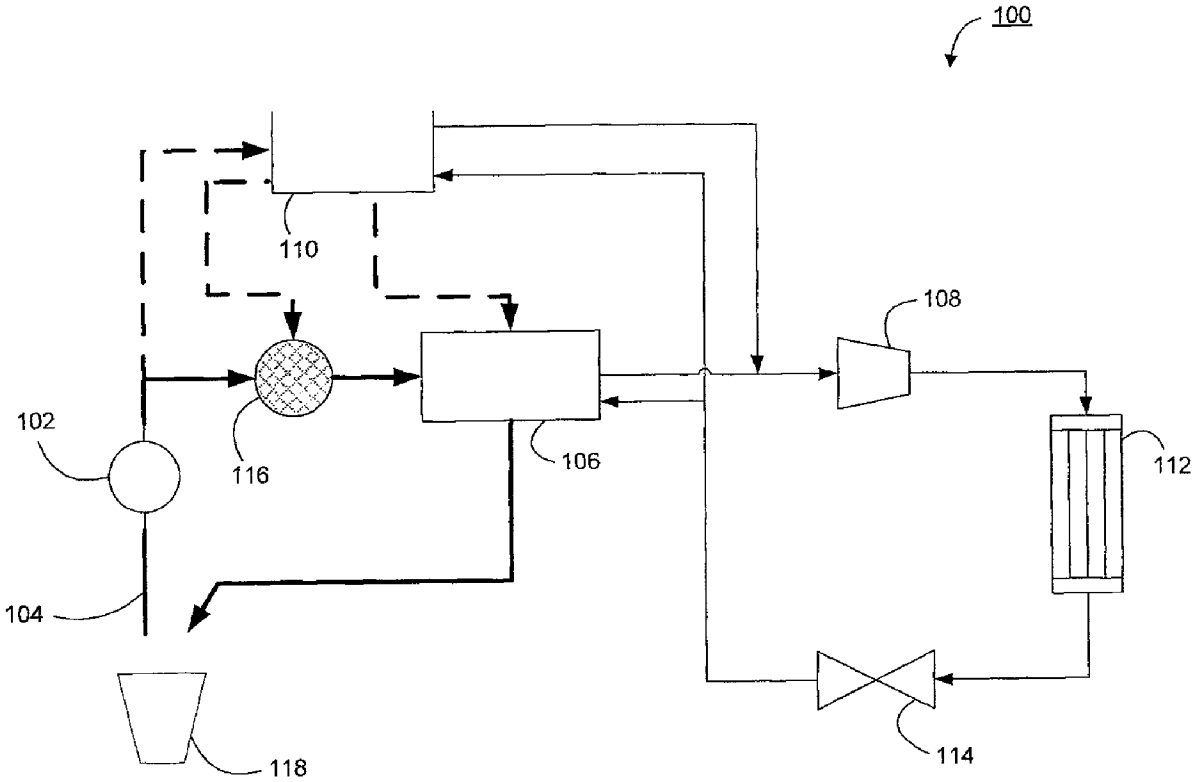
FIG. 1 illustrates an apparatus for instant ice making according to one embodiment of the present invention.
Figure 2:
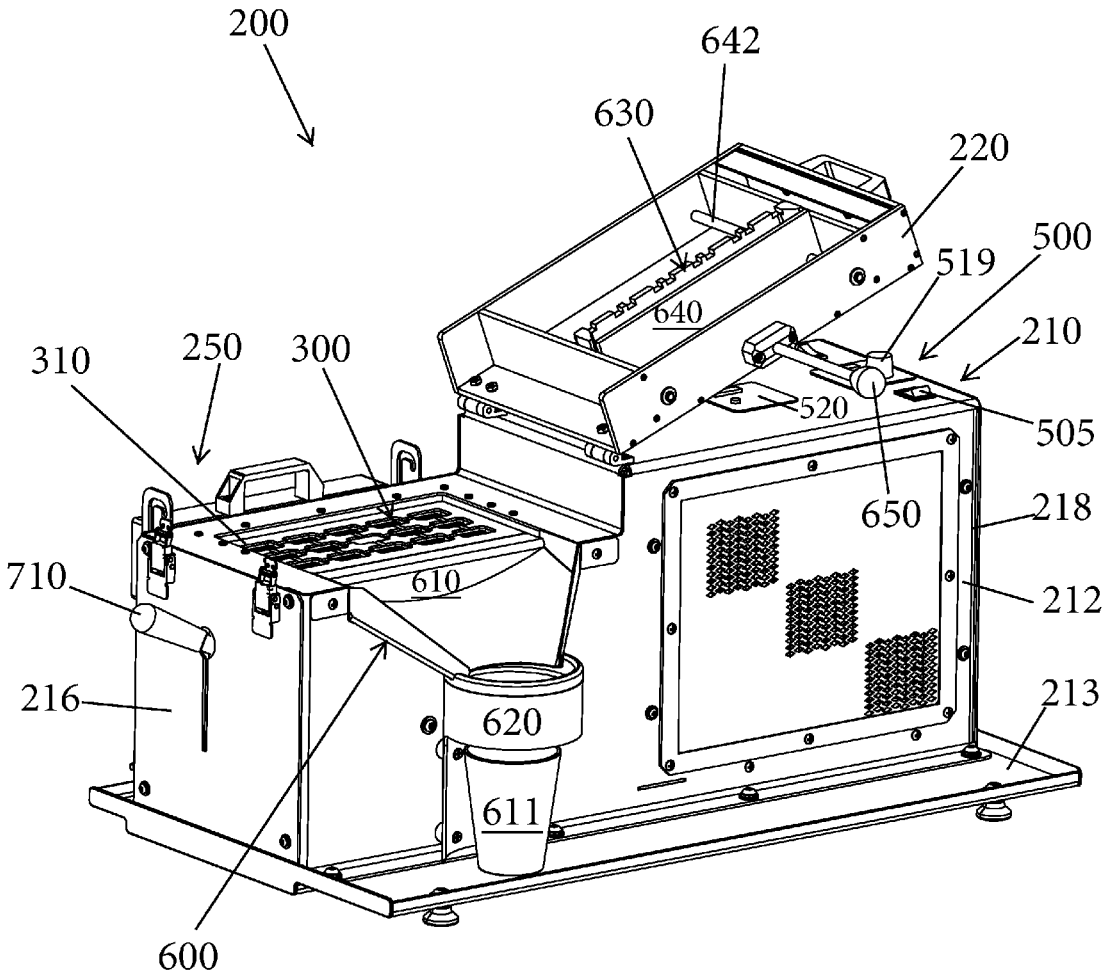
FIG. 2 is a front perspective view of an apparatus for instant ice making according to another embodiment of the present invention.

The apparatus according to embodiments of the present invention may take any number of shapes, including maintaining an outward appearance similar to a standard ice cube machine, coffee-maker machine, a Keurig® machine or a fountain soda machine, with specific space under a spigot for a cup to be placed (e.g., a "cup-holder"). FIG. 1 presents an exemplary apparatus according to an embodiment of the present invention. The apparatus 100 generally siphons liquid from any beverage container 118 or allows users to place liquid into the apparatus 100, e.g., into a receiving tank 110. In the former, that apparatus includes an area/seat for a user to place a beverage container 118 in the proximity of a siphon tube 104, which suctions the liquid directly from the container 118 via pump 102, for example, in response to the user initiating a programmed ice making process. The siphon tube 104 may be retractable in that the tube 104 lowers from the apparatus into the beverage container 118 and retracts back away from the container 118 when a sufficient amount of liquid is suctioned therefrom. In the latter, a user may pour the liquid into the receiving tank 110 of the apparatus 100. Alternatively, the liquid siphoned from the container 118 may be deposited into the receiving tank 110 for subsequent use. That is, liquid deposited in the tank 110 in connection with previous uses may be chilled (e.g., just above freezing temperature) so that the liquid in the tank 110 is ready for use on demand and liquid siphoned during subsequent uses makes up for the liquid removed from the tank 110 during the subsequent use. After initiating the apparatus 100, the liquid or a portion of the liquid may be frozen by utilizing a quick freeze process/mechanism 116 as discussed herein.

In one embodiment, quick freeze process/mechanism 116 includes cryogenic freezing using liquid gases (such as liquid carbon dioxide or liquid nitrogen). That is, the liquid entering via pump 102 or tank 110 may be exposed directly to the liquid gases within the quick freeze mechanism 116, which freezes or nearly freezes the liquid essentially immediately. In another embodiment, the liquid may be frozen in chilled molds 106. In yet another embodiment, quick freezing may include siphon tube 104 disposed to be brought into contact with a chilled surface of a refrigerant pipe at quick freeze mechanism 116, through which low-temperature refrigerant flows, such that liquid passed through the liquid supply pipe may be cooled by heat-exchange with the refrigerant. In another embodiment, the apparatus 100 uses a two stage process whereby liquid is exposed in a first stage to the mechanism 116, which reduces the temperature to near freezing relatively quickly. Thereafter, the low temperature liquid is placed into molds 106 that completes the freezing cycle and produces the desired shape. In one embodiment, the quick freeze mechanism 116 and/or the molds 106 serve as evaporators in a refrigeration system that includes a compressor 108, a condenser 112, and an expansion valve 114 or the like.

The quick freezing mechanism 116 will create extremely cold temperatures in sections of the apparatus, either constantly or instantly on demand, and will maintain such temperatures in one or more sections of the apparatus in order to freeze or nearly freeze the liquid in as little as approximately 30 seconds to a minute. Once the liquid is frozen or nearly frozen, ice cubes can be created. The apparatus may utilize a mechanism whereby the newly created ice cubes will be removed, dropped or placed back into a container 118 from which liquid may be siphoned from, therefore resulting in instant ice cubes of any desired beverage. The apparatus may maintain capabilities to initiate a "self-clean cycle" and properly clean the apparatus of any previous liquids and prepare the apparatus for another use.

According to an alternative embodiment, quick freezing mechanism 116 may cryogenically or flash freeze liquid received from siphon tube 104 or tank 110 into "pellets." The pellets may be created in any size suitable to instantaneously or substantially instantaneously freeze the liquid. Frozen liquid pellets may either be dispensed back into container 118 for consumption or collected into molds 106. In the latter, pellets collected into 106 may be used to form ice cubes by the addition of additional liquid received from siphon tube 104 or tank 110. The liquid in addition to the chilling of molds 106 promotes melding of the frozen pellets with the unfrozen liquid and thus creating ice cubes.

According to one embodiment, coffee shops and fountain soda machines may be target markets for use (e.g., ball parks and sporting events, amusement parks, restaurants, or any other commercial uses). In other embodiments, the apparatus of the present invention may be for at-home use in, for example, refrigerators and freezers, or as a standalone appliance.

FIG. 1 is a schematic illustration allowing for an explanation of the present invention. It should be understood that various aspects of the embodiments of the present invention could be implemented in hardware, firmware, software, or combinations thereof. In such embodiments, the various components and/or steps would be implemented in hardware, firmware, and/or software to perform the functions of the present invention.

Notably, the examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

Now turning to FIGS. 2-15 in which an apparatus 200 in accordance with another embodiment of the present invention is illustrated. The apparatus 200 is similar to apparatus 100 in that it is configured to provide rapid (instant) freezing of a freezable liquid, including flavored liquids, using a quick freezing mechanism that is described in detail below. As discussed herein, one of the advantages of the apparatus 100 is its ultra-compact design (small footprint) and its ability to rapidly freeze liquids due to the construction of the ice chamber which can be cooled to temperatures of below 0° F., preferably −10° F. or below and more preferably, at least about −20.0° F. (e.g., and can be down to temperatures of about −30.0° F. or below). The overall design and operation of the apparatus 200 allows the ice chamber to be chilled to temperatures down to about −50.0° F. By maintaining the ice chamber at such low temperatures, rapid freezing of the liquid is possible. In accordance with the present invention, rapid freezing refers to freezing the liquid into a frozen solid mass within a prescribed time period that is preferably less than about 1 minute and preferably is less than about 30 seconds for some applications. It will be appreciated that the above values and ranges are merely exemplary in nature and it is possible for the values to lie outside these ranges for certain applications (i.e., a specific freezable liquid). In any event, the amount of time needed to produce frozen masses, such as ice cubes, is substantially reduced compared to conventional ice making technologies. Since the formation of the ice cubes is very rapid, "instant" ice cubes can be readily formed in an on demand basis. Unlike traditional ice making in which ice cubes are made and then stored for some time before use, the apparatus 200 of the present invention allows ice cubes to be made in real time when there is individual demand. For example, when an individual wishes to cool a beverage, the user can simply add the freezable liquid to the apparatus 200 and within 1 minute, ice cubes or the like are formed and can be placed in the beverage. Freezing times can be between about 30 second and about 45 seconds—depending upon the liquid and the characteristics of the cooling system.

The apparatus 200 is formed of a number of parts that can be categorized as belonging to different sub-assemblies of the apparatus 200. More specifically, the apparatus 200 can include one more of the following: a main housing/frame assembly 210; a fluid intake assembly 250, an ice chamber and ice tray assembly 300; a cooling system 400; electronics and controls 500; a dispensing mechanism 600; and an optional ejector mechanism 700. It will be understood that the term "ice" is being used herein to describe the solid frozen state (solid mass) of a freezable liquid which is not limited to being water and in fact can comprise any number of different liquids, including flavored beverages, etc., as described herein. So long as the liquid can be rapidly frozen under the operating conditions (parameters) of the apparatus 200 as described herein, such liquid can serve as a freezable liquid.

The apparatus 200 includes main housing 210 which provides a frame and serves to contain and support the operating parts of the apparatus 200. As discussed herein, one of the advantages of the apparatus of the present invention is that it has a small footprint compared to existing commercial ice making systems which have much larger footprints and are not meant to be transportable. For example, the apparatus 200 is intended to be a table-top apparatus and thus, has appropriate dimensions to permit the apparatus 200 to be placed on a traditional countertop or other support surface, such as a table or the like (the dimensions of the apparatus 200 are such that it is not meant to be disposed directly on a floor surface). In one exemplary embodiment, a length (L) of the apparatus is less than about 36 inches (e.g., about 30-34 inches); a height (H) is less than about 18 inches (e.g., about 15 inches) and a width (W) is less than about 20 inches (e.g., about 18-19 inches). It will be appreciated that the preceding dimensions are merely exemplary in nature and are not limiting of the scope of the present invention. One will understand that the preceding exemplary dimensions allow the apparatus 200 to be transportable and sit on a countertop or table during its intended use.

The housing 210 has a top 211, a front 212, a rear 214, a first end 216, and an opposing second end 218. As shown, the housing 210 can be mounted to a substrate 213 which is disposed below the housing 210 and provides a surface to which working components can be mounted. Fasteners, such as bolts and the like, can be used to mount the housing 210 to the substrate 213. The bottom of the substrate 213 can include feet or the like to protect the surface (e.g., a countertop) on which the apparatus 200 rests. In the illustrated embodiment, the housing 210 is generally rectangular in shape.

As discussed herein, the apparatus 200 includes various stations that are located about the housing 210 and permit the user to perform different operations thereat. In particular, the apparatus 200 is constructed to allow a user to add a prescribed quantity (volume) of a freezable fluid which is to be frozen. The working components of the apparatus 200 operate to instantly freeze this added freezable liquid into one or more frozen solid objects/masses (e.g., ice cubes) and then the user can dispense the formed solid objects. The illustrated embodiment is constructed to direct the formed frozen objects into a receptacle, such as a cup.

The fluid intake assembly 250 and ice chamber and ice tray assembly 300 are configured to receive the freezable liquid and direct it to the ice chamber and ice tray assembly 300 at which the quick freeze step occurs (i.e., the freezable liquid is frozen within a short duration of time, such as less than about 1 minute) and frozen objects are formed.

It will be appreciated that any number of different fluid intake assemblies and mechanisms can be used so as they are configured to allow the user to deliver a prescribed quantity of the freezable liquid to the ice chamber for controlled freezing thereof. Since the freezable liquid that is delivered to the ice chamber is frozen very quickly, the fluid intake assembly is configured to deliver the fluid to multiple cells when it is desired to form multiple frozen objects, such as multiple ice cubes, etc. In other words, the added freezable liquid is preferably delivered simultaneously to the multiple cells to allow freezing to occur in each cell at or near the same time. In this way, the freezing process is concluded at or near the same time in each cell.

In one exemplary embodiment, the fluid intake assembly 250 is a manifold based assembly and in particular, includes a fluid dispenser 260 and a dispenser manifold 270 that is in fluid communication with the fluid dispenser 260. These components can be fixedly attached to the housing 210 at a permanent location or, as in the illustrated embodiment, these parts can be movable relative to the housing 210 between an in-use position and a storage position.

The fluid dispenser 260 is configured to receive the prescribed quantity of the freezable liquid and deliver it to the dispenser manifold 270. As shown, the fluid dispenser 260 can be in the form of a trough that has an open top that receives the freezable liquid. The trough can include slanted side walls 262 that lead to a bottom floor that includes a plurality of openings 263. The openings 263 are located along the length of the bottom floor of the trough. The fluid dispenser 260 can include a handle 265 to allow the user to move the fluid dispenser 260 when the dispenser is of the type that moves between two positions. In the illustrated embodiment, the fluid dispenser 260 and dispenser manifold 270 are disposed vertically along the rear of the housing 210 in the storage position and are disposed horizontally along the top of the housing 210. Guides can be used to assist in movement of the fluid dispenser 260 and dispenser manifold 270 between these two positions.

The dispenser manifold 270 is configured to receive the freezable fluid that flows through the openings 263 (which thus define an entrance to the dispenser manifold 270). The dispenser manifold 270 is formed such that it has an integral channel architecture that routes the freezable liquid from one location to another location. More specifically, the dispenser manifold 270 includes a top surface that has a series of inlet ports that axially align with the openings 263 for receiving the freezable liquid from the dispenser 260. Integral and internal to the dispenser manifold 270 is a series of channels 272 that carry the freezable liquid from the inlet ports to exit ports 274 located along the bottom of the dispenser manifold 270. For example, for each inlet port, there is one internal channel that extends between one inlet port and one corresponding exit port. Alternatively, one inlet port can be fluidly connected to more than one exit port 274 by the internal channel 272. The freezable liquid flows by gravity within the channel architecture of the dispenser manifold. The dispenser manifold 270 is thus designed to receive the freezable liquid from the dispenser 260 and then route the fluid along distinct flow paths to exit ports which are in fluid communication with the ice (freeze) chamber. As will be understood below, each exit port 274 of the dispenser manifold 270 is in fluid communication with one cell of the ice chamber for forming one solid frozen object, such as an ice cube.

Figure 3:
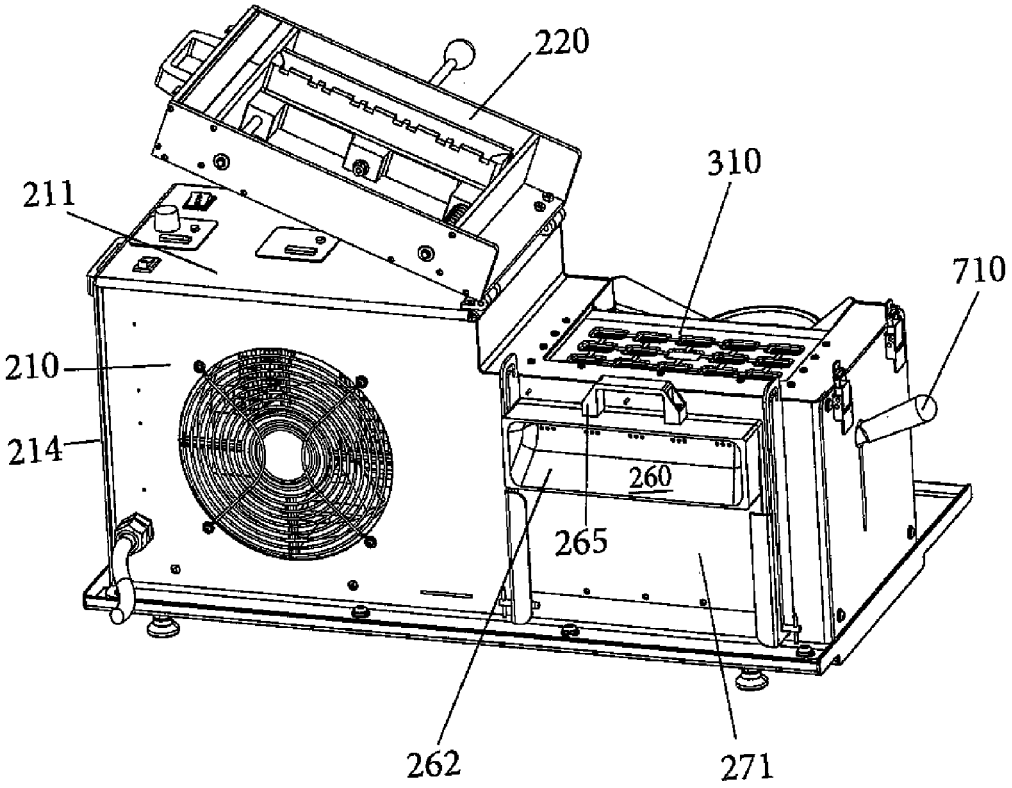
FIG. 3 is a rear perspective view of the apparatus.
Figure 4:
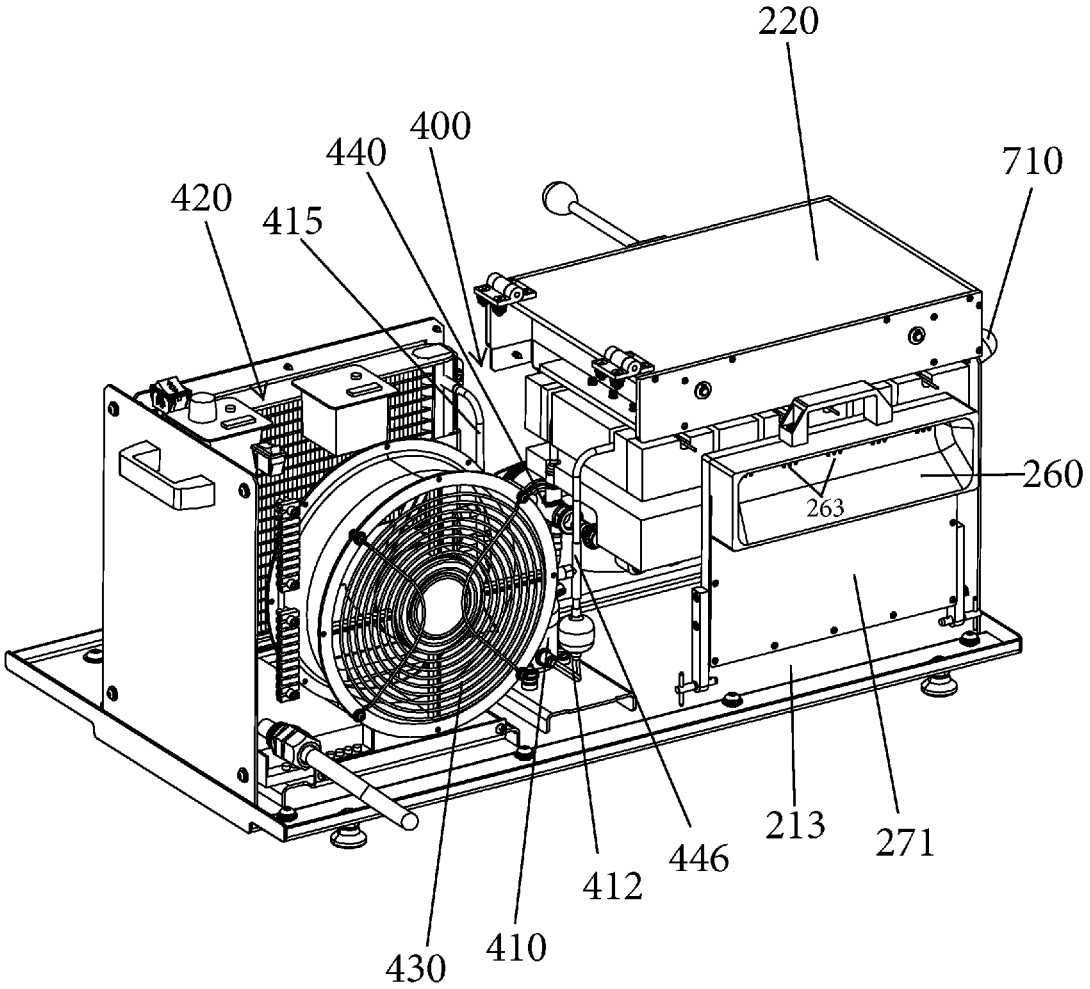
FIG. 4 is a rear perspective view of the apparatus with the housing removed.
Figure 5:
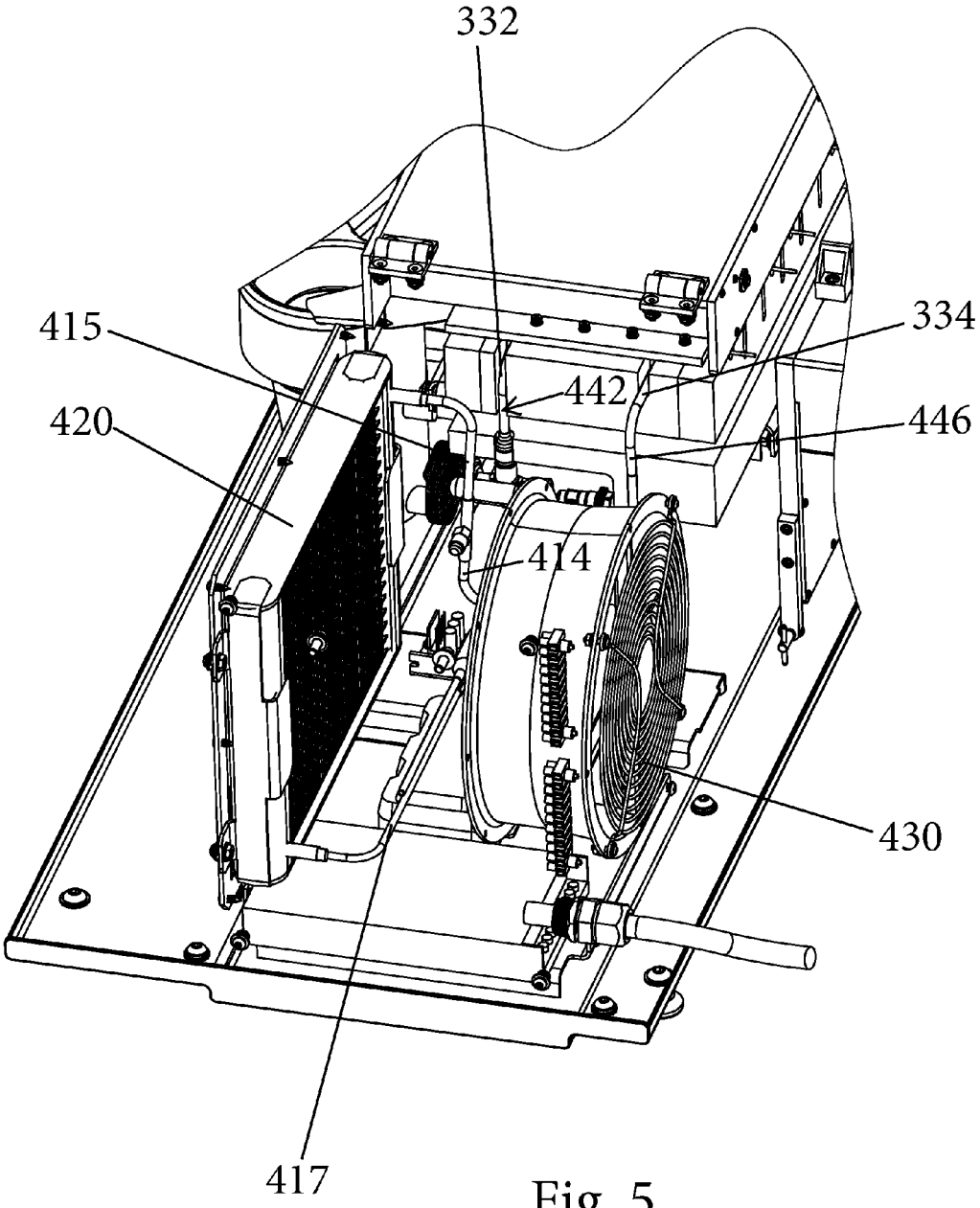
FIG. 5 is a top perspective view of a cooling system of the apparatus.

In FIGS. 3 and 4, the channels 272 and exit ports 274 are covered by a cover 271 which protects the integrity of the fluid pathways.

It will also be understood that an "ice cube" is not limited to having a cube shape but instead is used to generally describe a frozen mass that can assume any number of different shapes, including regular shapes, such as oval, triangular, etc., and irregular shapes. The depth of the ice cube can likewise vary.

Figure 6:
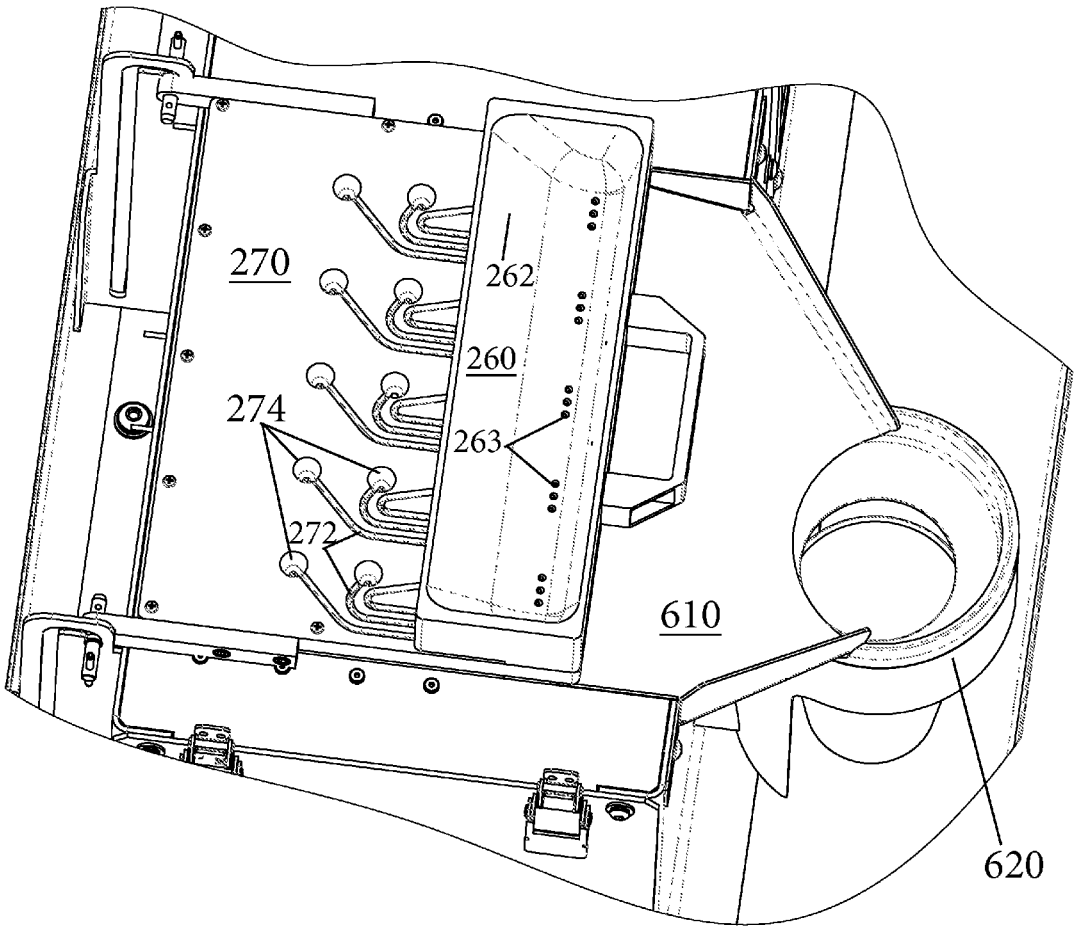
FIG. 6 is a top perspective view of a dispenser and dispenser manifold.
Figure 7:
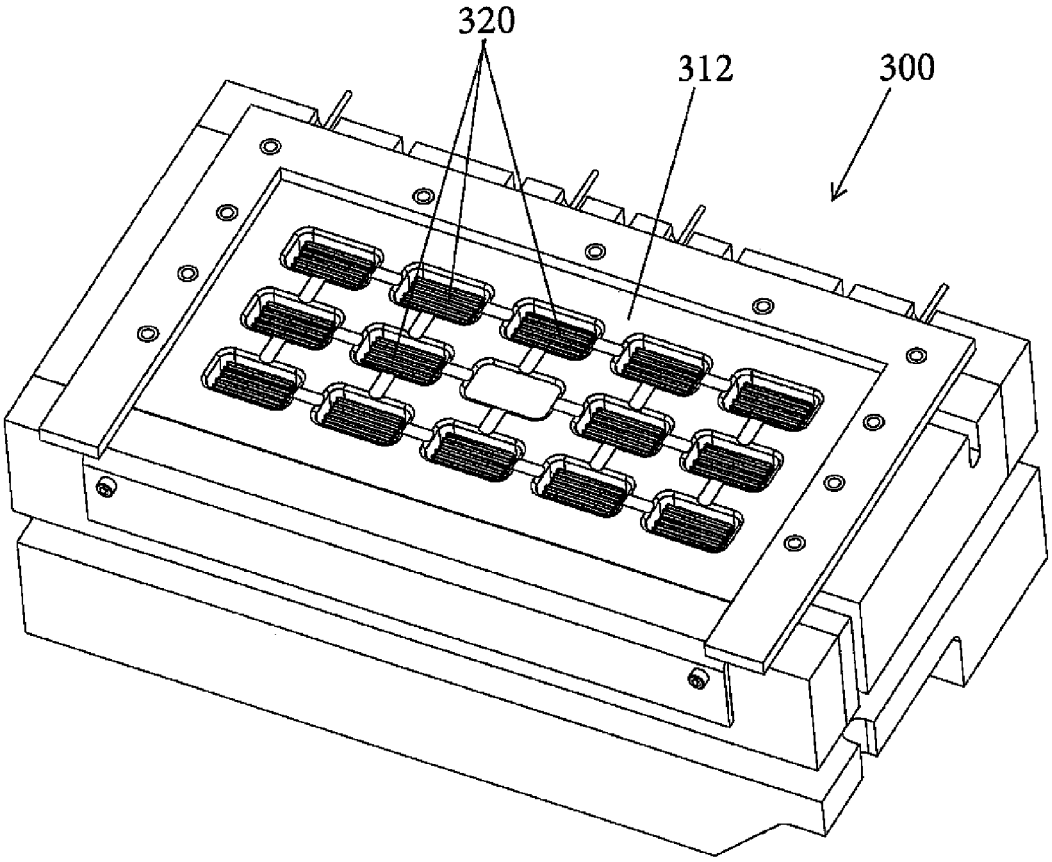
FIG. 7 is a top and side perspective view of a freeze block assembly.

The fluid dispenser 260 and dispenser manifold 270 can be attached to one another using any number of different techniques, including but not limited to the use of fasteners and the like. FIG. 6 shows the combined dispenser 260 and dispenser manifold 270 in the in-use position in which the top of the dispenser 260 faces upward for receiving the freezable liquid. In the illustrated embodiment, the housing 210 includes a cooling compartment cover 220 that is movable between an open position (FIG. 3) and a closed position (FIG. 4). The cover 220 can be pivotally attached to the housing 210 to permit movement between these two positions. In the open position, the ice chamber is exposed and is accessible and it is also in this open position of the cover 220 that the combined dispenser 260 and dispenser manifold 270 can assume the in-use position over the ice chamber for delivering the freezable liquid thereto. During the ice making operation, the cover 220 is in the closed position.

The ice chamber is defined by a number of parts including the ice tray assembly 300 which as described herein is configured and is operatively connected to the cooling (refrigeration) system 400 for quick freezing the freezable liquid that is introduced into the ice (freeze) chamber. The ice tray assembly 300 includes an ice tray or freeze block 310 that generates freezing temperatures in the ice chamber of between about 0° F. and −50° F. (e.g. down to about −40.0° F. (e.g., between about −10.0° F. and −30.0° F.)). The freeze block 310 includes a top surface 312, an opposing rear surface 314, a first end 316 and an opposing second end 318. The freeze block 310 has a plurality of cells 320 formed integrally therein. The cells 320 define wells in which the freezable liquid is deposited and subject to the rapid (quick) freezing conditions described herein. The cells 320 thus define the shape of the ultimately formed frozen masses. In the illustrated embodiment, the cells 320 are generally rectangular shaped to form generally cube shaped frozen masses (ice cubes). Each cell 320 thus has a depth, width and length. It will also be appreciated that the freeze block 310 includes insulation.

Figure 12:
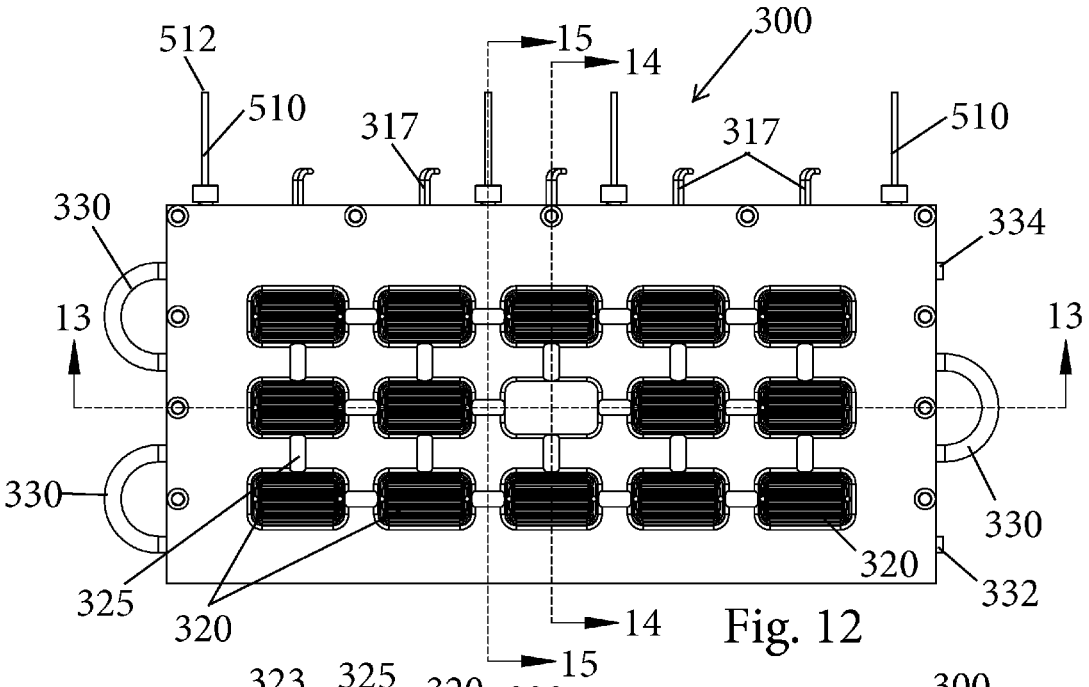
FIG. 12 is a top plan view of one exemplary freeze block assembly.
Figure 13:
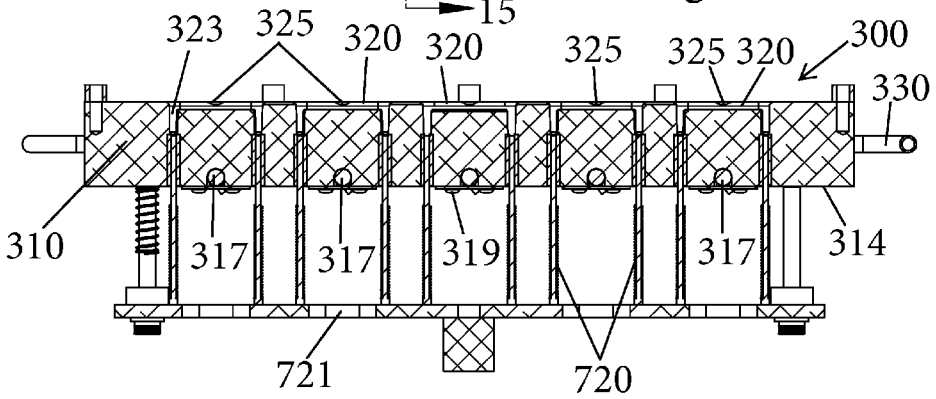
FIG. 13 is a cross-sectional line taken along the line 13-13 of FIG. 12.
Figure 14:
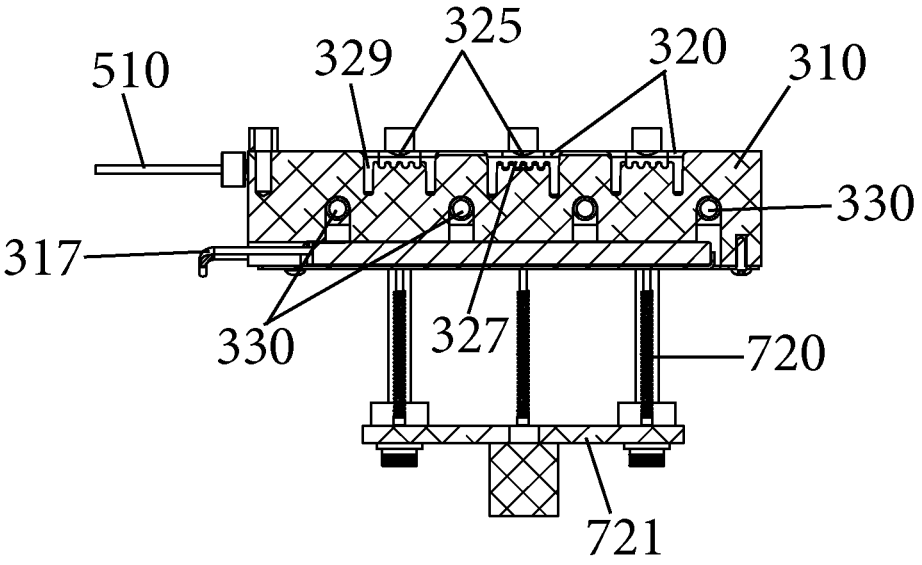
FIG. 14 is a cross-sectional line taken along the line 14-14 of FIG. 12.

In FIGS. 12-15, the cells 320 have a concave shape; however, other shapes are possible. The cells 320 are open along the top surface 312 for receiving the liquid to be frozen. The cells 320 can also be configured so as to form an at least substantially hollow ice cube. In particular and as shown in FIGS. 13-14, the ice cube cell 320 includes a central well and end wells 323 and side wells 329 that are all in fluid communication. The resulting ice cube thus has a hollow center with side and end walls extending about the hollow center. The center well can include fins 327 which are formed along the central well portion and serve to increase surface area and thus increase heat transfer area, thereby resulting in increased cooling/freezing times.

FIGS. 12-15 show that there can be channel 325 formed on the top surface 312 that fluidly connect and extend between two cells 320. The channel 325 can be a shallow concave shaped channel formed along the top surface 312 so as to fluidly connect one cell 320 to one other cell 320. As shown in FIG. 12, there can thus be a network of channels 325 that connect the cells 320. These channels 325 can receive overflow fluid that is introduced into the cells 320.

When the combined dispenser 260 and dispenser manifold 270 are placed over the ice tray assembly 300, at least one exit port is in fluid communication with one cell 320 and therefore, the freezable liquid flows by gravity from the manifold 270 into the cells 320. The cells 320 are thus open along the top surface of the freeze block 310. The cells 320 are spaced apart from one another and formed in an array. The separation of the cells 320 allows cooling equipment to be routed integrally through the freeze block 310 both below and between the cells 320 as discussed below.

Figure 8:
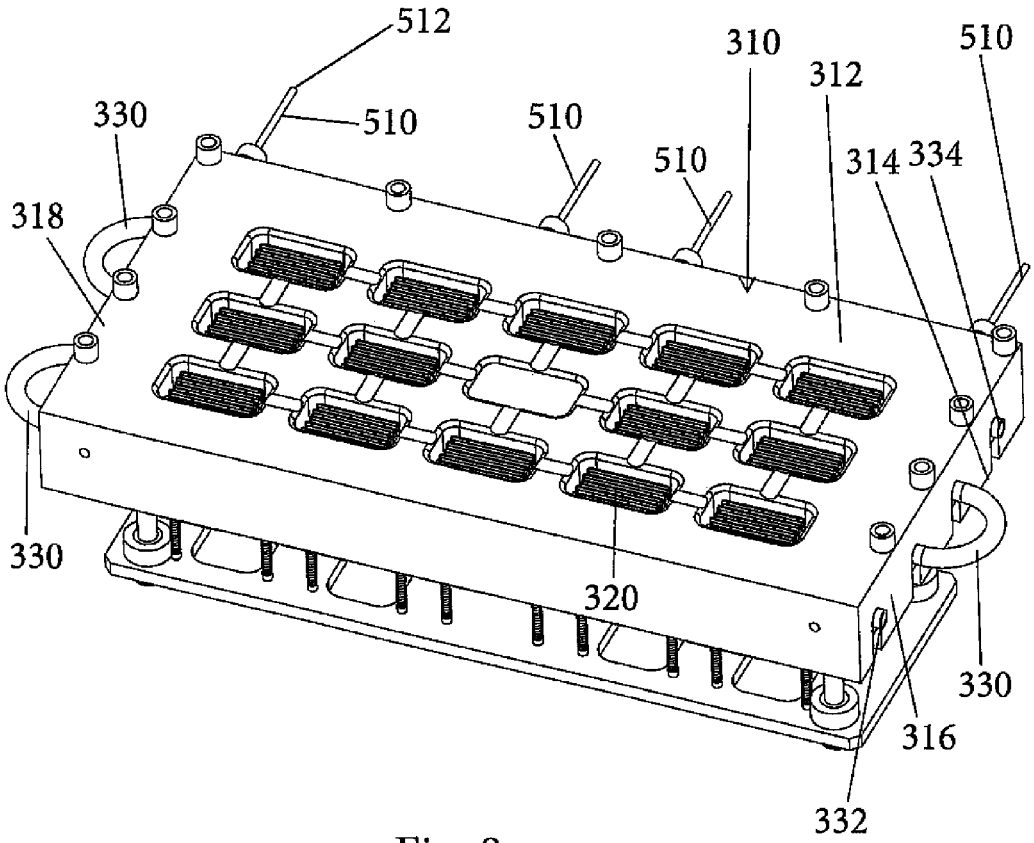
FIG. 8 is a top and side perspective view of a freeze block.
Figure 9:
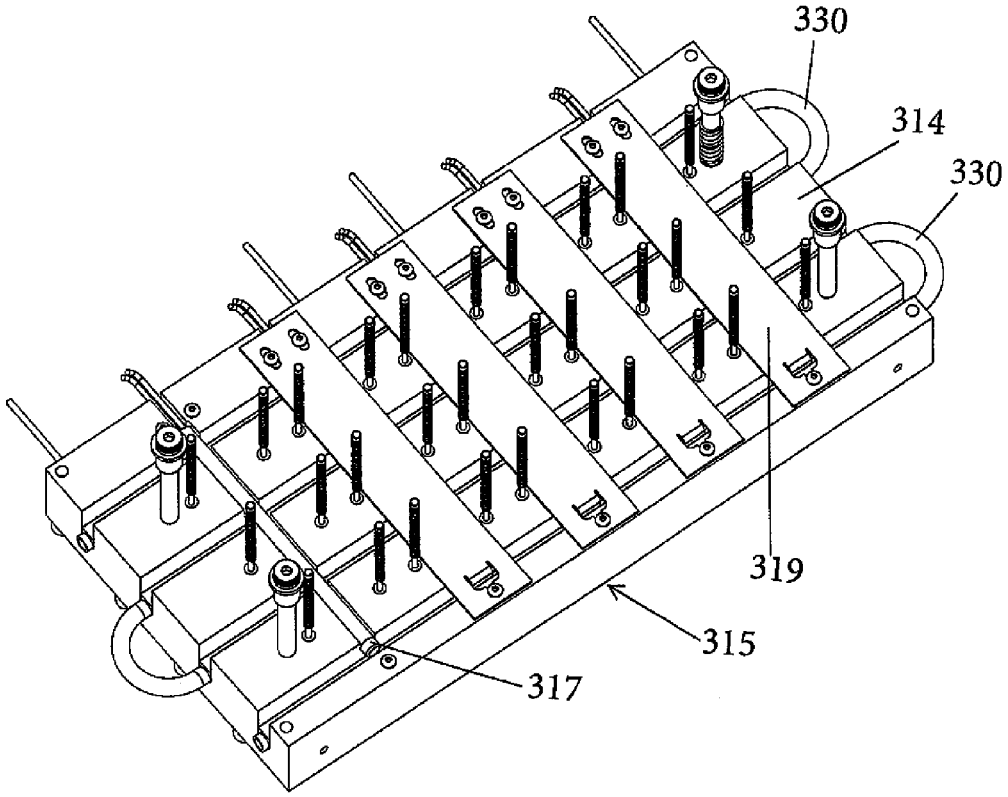
FIG. 9 is a bottom perspective view of the freeze block.
Figure 10:
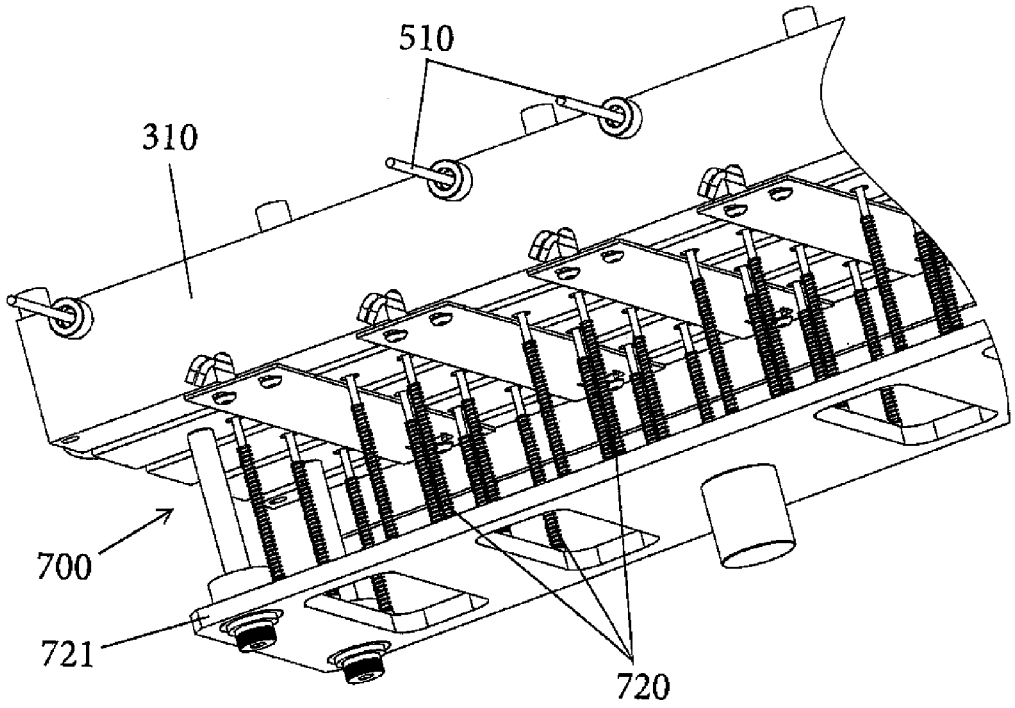
FIG. 10 is a bottom perspective view of an optional injector mechanism for use with the freeze block.
Figure 11:
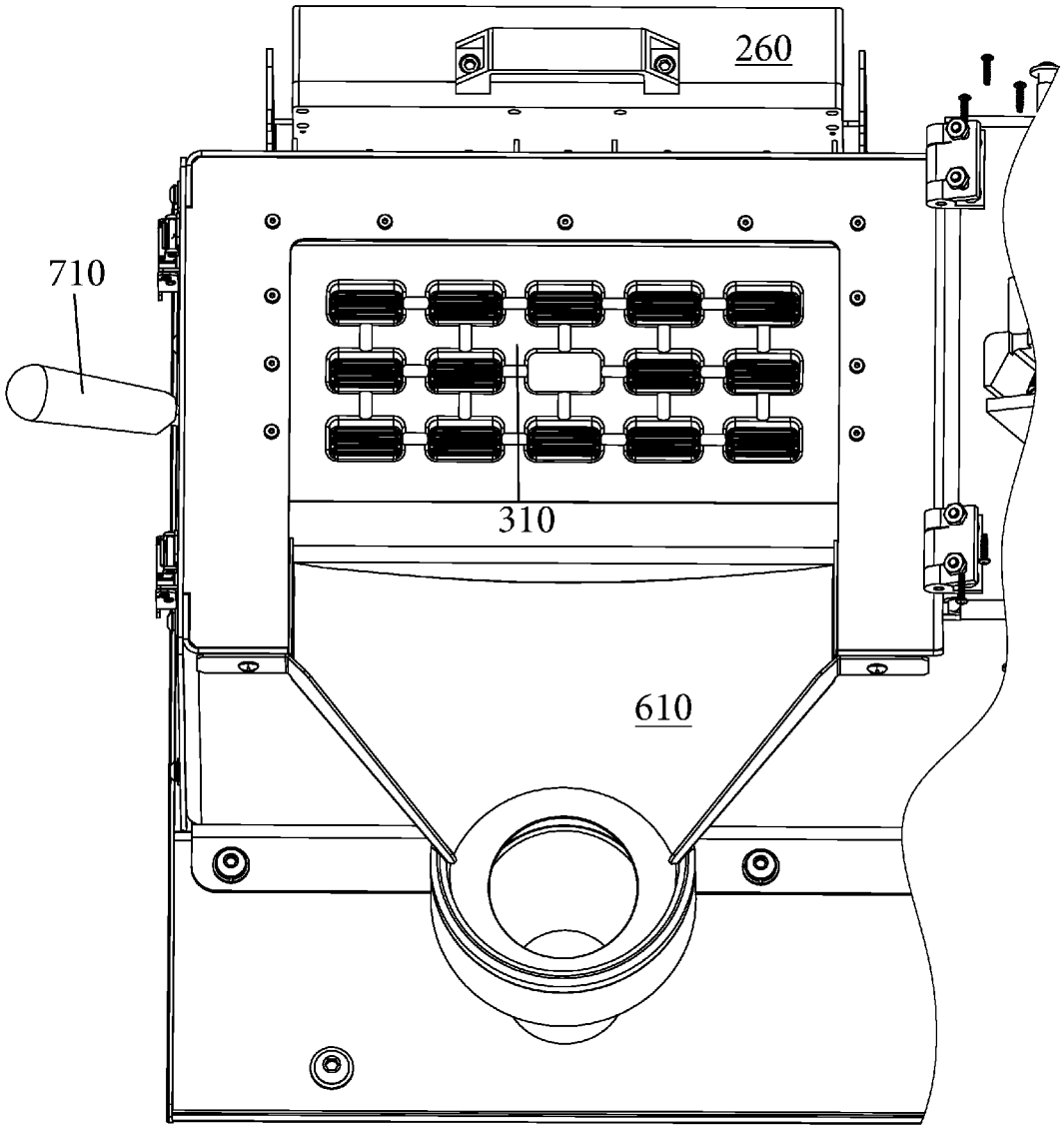
FIG. 11 is a top perspective view of a mechanism for removing the frozen objects (ice) from the freeze chamber.

FIG. 8 shows the top of the freeze block 310, while FIG. 9 shows an underside of the freeze block 310. FIGS. 12-15 also illustrate the freeze block 310. The freeze block 310 contains a cooling element 330 for rapidly yet controllably bringing the temperature of the freeze block 310 to the target cooling temperatures described herein (below 0° F. and preferably less than −10° F. and can be less than about −20.0° F. (e.g., between −20.0° F. and −50.0° F. according to one embodiment) which is much colder than traditional ice making machines, thereby ensuring quick (instant) freezing of the freezable liquid within the cells 320. The cooling element 330 comprises conduits that carry refrigerant through the block 310 and more particularly, the cooling element 330 comprises evaporator lines (coils) that are routed within the freeze block 310 in close proximity to the cells 320. As shown, the cooling element 330 can be in the form of a coiled conduit (pipe) that has a serpentine shape and extends lengthwise within the freeze block 310. The cooling element 330 is preferably a continuous structure that has an inlet 332 and an outlet 334. The inlet 332 and outlet 334 can be located at the same end of the block 310 as shown. As described herein, the inlet 332 and outlet 334 are operatively connected to the cooling system 400 which supplies and receives back the refrigerant, thereby forming a closed refrigerant loop (cycle) as described below.

The freeze block 310 is formed of a suitable material, such as a metal (e.g., aluminum) that facilitates heat transfer from the freezable liquid to the block 310 itself (resulting in the freezing of the freezable liquid) and then ultimately heat is transferred from the freeze block 310 to the refrigerant that flows through the freeze block 310, thereby cooling the freeze block 310. Thus, there is a continuous cooling cycle in which the heat is drawn from the freezable liquid to the block 310 resulting in rapid freezing of the freezable liquid and heating of the block 310; however, the block 310 is cooled back down to the target temperature range as result of the heat transfer from the block 310 to the refrigerant that is flowing through the cooling conduits/lines formed integrally within the block 310. The cooling elements 330 thus comprise heat-exchanging lines that are disposed internally within the freeze block 310 and serve to carry the refrigerant which acts as a heat exchange fluid for absorbing the heat transferred to the block 310. The space above the ice block 310 is maintained at or below the target temperature range (e.g., below 0° F. and preferably below about −10.0° F.).

As mentioned, the apparatus 200 includes electronics and controls 500 to provide feedback and control over the operating parameters of the apparatus 100 including the temperature of the freeze block 310. The freeze block 310 can include at least one sensor for monitoring the temperature of the freeze block 310 and thus, the temperature of the ice chamber. In the illustrated embodiment, there is a plurality of temperature sensors 510 for monitoring the temperature of the block 310. For example, the temperature sensors 510 can be in the form of thermocouples that measure temperature. The thermocouples 510 (e.g., four thermocouples) can be positioned at different locations of the freeze block 310 to record temperatures at these different locations. Free ends 512 of the thermocouples 510 can be disposed along one side of the freeze block 310 to allow connection to the electronics, such as a master controller/processor, to continuously provide temperature feedback to the user.

The freeze block 310 optionally includes an integral heater 315 that is operable to cause select heating of the cells 320 to assist in the ejection of the formed frozen masses from the cells 320. For example, the integral heater 315 comprises a plurality of heating elements 317 that are disposed within the freeze block 310 in close proximity to the cells 320. For example, the heating elements 317 can be disposed between rows (or columns) of cells 320 and thus be located proximate the cells 320. The heating elements 317 are operably connected to a power source (e.g., electric) and the controls 500 and when operated, each heating element 317 generates heat within the freeze block 310 proximate the cells 320. The heating elements 317 can be disposed within channels formed in the underside of the block and then secured and maintained in place by heater retainers 319 (plates that are mounted to the underside of the block 310 that cover the heating elements 317). Controls, such as an on-off switch, can be provided to control operation of the heater.

Figure 15:
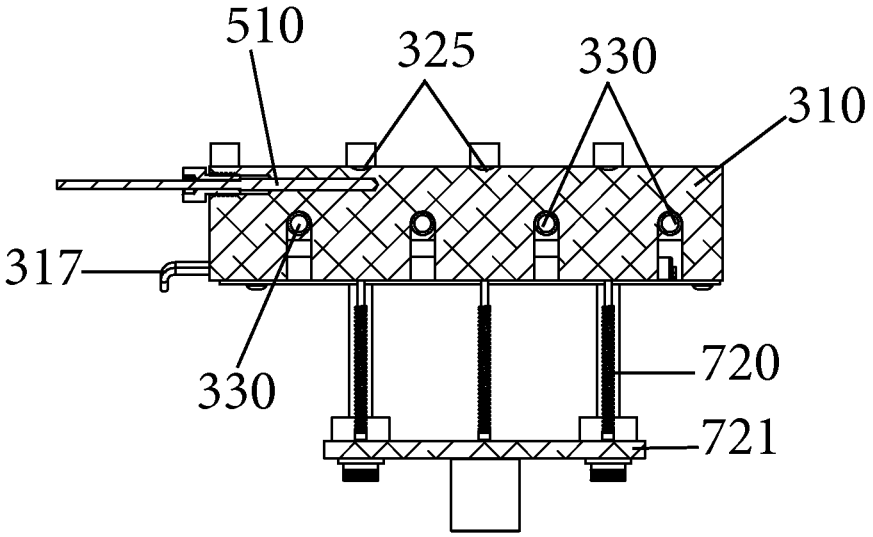
FIG. 15 is a cross-sectional line taken along the line 15-15 of FIG. 12.

FIG. 13 clearly shows the heating elements 317 being disposed below the cells 320 and in particular, they are routed along the bottom surface 314 of the block 310. For each cell 320, there is one heating element 317 that is located therebelow. The heating elements 317 run transverse across the block 310 with one heating element 317 being disposed below a plurality of cells 320 and thus one heating element 317 acts to heat the plurality of cells 320. In the illustrated embodiment, one heating element 317 lies below three cells 320. As shown in FIGS. 13-15, the heating elements 317 lies below the coils 330 which are routed internally within the block 310. As shown, the coils 330 are generally centrally located within the block 310.

The cooling system 400 of the present invention is operatively connected to the ice tray assembly 300 to controllably cool the freeze chamber and assembly 300 to the target temperatures described herein. Any number of different types of cooling systems 400 can be used so long as they can rapidly cool the block 310 to the target temperature range and also can fit within the small footprint of the apparatus 200 (i.e., within the housing).

In one embodiment, as described herein, the cooling system 400 employs a vapor compression cycle for cooling the ice block 310. In this cycle, a circulating refrigerant, such as HFC-404A, enters a compressor 410 as low-pressure vapor. The vapor is compressed and exits the compressor 410 as high-pressure superheated vapor. This high-pressure superheated vapor travels though coils or tubes comprising a condenser 420. These coils and tubes can be cooled passively by exposure to air in the room in which the apparatus 200 is located and/or can be actively cooled by a fan 430. The condenser 420 cools the vapor which liquefies. As the refrigerant leaves the condenser 420, it is still under pressure but is at lower temperature. The liquid refrigerant is forced through a metering or throttling device, known as an expansion valve 440 to an area of much lower pressure. The sudden decrease in pressure results in explosive-like flash evaporation of a portion of the liquid refrigerant. The latent heat absorbed by this flash evaporation is drawn mostly from still-liquid refrigerant. This now cold and partially vaporized refrigerant continues to the evaporator unit which in this case is the ice block 310 and in particular, the cooling element(s) 330 thereof. The refrigerant completely vaporizes as it travels through the cooling element 330 and absorbs heat from the surrounding ice block 310 as discussed herein. Refrigerant leaves the evaporator (ice block 310) now fully vaporized and slightly heated and returns to the compressor inlet to continue the cycle.

The individual parts of the cooling system 400 are now described. The compressor 410 is mounted to the substrate 213 and is in the form of a mini-compressor which is compact and lightweight yet is powerful enough to chill the ice block 310 to the target temperature range. One exemplary mini compressor 410 is commercially available from Aspen Systems of Marlborough, Mass. The compressor 410 includes an inlet 412 through which the refrigerant is delivered to the compressor 410 and an outlet 414 through which the compressed, high-pressure refrigerant exits the compressor 410. A first condenser line (inlet line) 415 is connected to the outlet 414 of the compressor 410 and to an inlet of the condenser 420. The condenser 420 can be mounted vertically within a frame that is attached to the substrate 213. The condenser 420 includes a series of coils and conduits (tubes) that receive the high-pressure superheated vapor from the compressor 410 and serve to cool the vapor to form liquid refrigerant. The liquid refrigerant exits an outlet of the condenser 420 and travels within a condenser outlet line 417.

Fan 430 is vertically mounted within the housing and is disposed proximate and in facing relationship to the condenser 420. Operation of the fan 430 serves to draw air into an air intake of the condenser 420 for cooling the condenser coils and the refrigerant flowing through these condenser coils.

The condenser outlet line 417 fluidly connects the condenser 420 to the expansion valve 440. A first evaporator line 442 (downstream of the expansion valve 440) connects the expansion valve 440 to the inlet 332 of the cooling element 330, thereby delivering the cold and partially vaporized refrigerant to the ice block 310. This cold and partially vaporized refrigerant flows within the coil structure of the cooling element 330, thereby cooling the ice block 310 to the target temperature. The refrigerant completely vaporizes as it travels through the cooling element 330 and absorbs heat from the surrounding ice block 310 as discussed herein resulting in chilling of the ice (freeze) block 310.

The outlet 334 of the cooling element 330 (evaporator coil) is connected to a second evaporator line 446 that is fluidly connected at its other end to the compressor 410, thereby completing the vapor compression cycle. As a result, the now fully vaporized refrigerant exits the ice block 310 and is returned through the second evaporator line 446 to the compressor 410.

The electronics and controls 500 of the apparatus provide for easy operation of the apparatus and provide feedback to the user and also allow the user to control the operation of the apparatus. A main power switch 505 is provided and is accessible along the exterior of the housing, such as along the top of the housing. Operation of the main power switch 505 controls operation of the mini compressor 410. In the illustrated embodiment, the switch 505 is a toggle switch that moves between an on position and an off position. One or more displays 520 are provided for providing feedback to the user over the operation of the apparatus. For example, one or more displays 520 can provide information from the plurality of thermocouple devices 510 that register the temperature of the ice block 310 in different regions (zones) thereof. The displays 520 can be digital displays. It will be appreciated that a single display 520 can be provided for displaying the temperature data in the multiple regions of the ice block 310 (e.g., the single display 520 can display all of the temperature data simultaneously or can include a scrollable menu to access such information).

The electronics 500 also preferably includes a temperature controller 519 that permits the user to adjust and set the temperature of the ice chamber to a desired temperature level. In other words, the operation of the temperature controller 519 serves to adjust the temperature of the ice (freeze) block 310.

As mentioned previously, the electronics 500 also preferably include a processor (circuit board) and a memory in which data can be stored.

The apparatus 100 is powered by a main power source which can be a DC power source. In other words, a power cable of the apparatus can be simply inserted into an electric outlet for powering the apparatus 200.

The dispensing mechanism 600 is configured to allow the frozen masses (e.g., ice cubes) to exit the ice (freeze) chamber and be delivered to the user. For example, the dispensing mechanism 600 can be in the form of an ice chute 610 that is disposed proximate the ice chamber. The ice chute 610 receives the frozen masses (ice cubes) from the cells 320 and is preferably configured to deliver the frozen masses to a single location. For example, the ice chute 610 has angled walls that lead to a dispenser outlet. Since according to one exemplary embodiment, the apparatus 200 is designed to deliver a quantity of frozen masses suitable for a single use, a cup holder 620 can be provided. The cup holder 620 is disposed adjacent the ice chute 610 and is configured to hold a cup 611 such that the open top of the cup is disposed next to the dispenser outlet. In this manner, the frozen masses (ice cubes) travel down the angled chute 610 into the cup 611.

It will be appreciated that the cup holder 620 can be adjustable to fit different sizes cups 611 or is otherwise removable (detachable) to allow different sized cups 611 to be used. However, the cup 611 is sized to hole a drink of a volume for personal consumption by one person.

As discussed herein, unlike conventional designs, the apparatus of the present invention is designed to sit on a countertop and is designed to produce an amount of ice (frozen mass/objects) that has a volume (mass) for personal consumption, such as for placement in a single conventionally sized glass, such as a 6-24 ounce glass (e.g., 10 ounce to 20 ounce glass).

As described below and according to one exemplary embodiment of the present invention, the total ice mass per cooling cycle (i.e., one freezing of the block 310) can be between about 20 grams and about 210 grams. Similarly, the number of cells 320 can vary depending upon a number of parameters, including the depth of each cell (volume per cell); however, for freeze blocks 310 of the scale utilized in the present invention, the number of cells 320 and thus, formed ice cubes (frozen masses), can vary from about 12 to 40 per tray (block 310).

In addition, the mass of the ice cube formed in each cell 320 can vary depending upon the dimensions of the cell 320 in which the ice cube is formed. In one exemplary embodiment, the mass of the ice cube formed in one cell 320 is about 3.85 grams and the cube has a surface area of about 5.25 square inch. In the illustrated embodiment, there are fifteen cells 320 and thus, the total mass of ice formed in 57.75 g. Using the present system, ice formation occurs in about 45 seconds at about −5° F. to −10° F. It will be appreciated that a longer time will freeze more mass, colder temperatures will freeze more mass with constant time.

In accordance with the present invention, each ice cube can have a mass between about 2 g to about 4 g. In the even that 2 g size ice cubes are formed, the number of cells 320 can be increased (e.g., from 15 to 25 per block 310) in order to obtain the desired total volume of ice (e.g., between about 50 g and about 58 g in one embodiment). It will also be appreciated that improved capacity of the employed cooling system can result in changes of the temperature of the liquid and also influence the size of the cells, etc. Based on the foregoing ice capacity values, one will understand the table top nature of the present apparatus 200 and that is it configured for the most part as a single serve apparatus. In other words, one cooling (freeze) cycle is designed and intended to create enough ice for a single use and more particularly, a single glass. Since the freezing time period is typically less than 1 minute, the apparatus 200 truly provides "instant" ice that is fresh and goes from being fresh formed to straight into the user's drinking glass. Unlike commercial ice making, the ice formed here does not sit in a storage area waiting for a person to dispense the ice for use.

The dispensing mechanism 600 can include an automated or manual mechanism for removing the frozen masses from the cells 320. When fully automated, the electronics and controls 500 control operation of such automated mechanism. For example, an actuator, such as a button or the like, can be activated to cause the controlled removal of the frozen masses from the cells 320.

The illustrated apparatus 200 includes a manual dispensing mechanism which is at least partially incorporated into the cover 220. More specifically, an ice sweeper mechanism 630 can be incorporated into the interior of the cover 220. The ice sweeper mechanism 630 is configured such that when the cover 220 is in the closed position, the ice sweeper mechanism 630 is disposed immediately above the cells 320 in the ice chamber and whereupon, actuation of the sweeper mechanism 630 causes the frozen masses in the cells 320 to be removed and directed to the ice chute 610. The illustrated ice sweeper mechanism 630 includes a frame that carries an ice sweeper 640 that is movable within the ice chamber and can travel across the entire ice block 310 or at least travels over all of the cells 320. The ice sweeper 640 can travel linearly along a pair of guides 642. An actuator 650 is operably connected to the ice sweeper 640 to cause controlled movement of the ice sweeper 640. The actuator 650 can be a rod-like structure with a knob that is grasped by the user.

The ice sweeper 640 can be a biased member (spring biased) such that at rest, it assumes one set position. The ice sweeper 640 can include a blade for contacting and removing the frozen masses from the cells 320.

The optional ejector mechanism 700 can be either an automated mechanism or can be a manual mechanism operated by the user. The ejector mechanism 700 is configured such that upon operation, an element is introduced into each cell 320 to contact and dislodge the frozen mass from the respective cell 320. The ejector mechanism 700 includes an actuator 710 for activating and operating the ejector mechanism 700. The actuator 710 can be a button, slider, or a lever (as shown). In the illustrated embodiment (see, FIGS. 13-15), the ejector mechanism 700 includes a plurality of pins 720 that are at least partially insertable into the cells 320 (e.g., insertable through a sealable opening formed along the floor of the cell 320) to cause dislodgement of the frozen mass that resides in the cell 320. Each cell 320 has at least one pin 720. The pins 720 can be formed as part of a substrate (plate) 721 that moves between an extended position (in which pins 720 are at least partially within the cells 320) and a retracted position (in which the pins 720 are outside of the cells 320).

A linkage operably connects the actuator 710 to the pins 720. The linkage thus translates movement of the actuator 710 into movement of the pins 720 between the extended and retracted positions. In one embodiment, the pivoting of the linkage is translated into the pin substrate 721 moving in an up and down motion. As shown in FIGS. 12-15, there can be two or more pins 721 per cell 320. However, one pin 721 can work equally as well. In the illustrated embodiment, two pins 721 are axially aligned with the end well portions 323 and therefore, the pins 721 drive the end walls of the formed ice cube. It will be appreciated that a sealing means or valve means can be provided between the end well portions 323 and the channel in which the pins 721 are driven to prevent liquid from escaping the cell 320. Alternatively, other means can be employed to separate the ejection mechanism.

It will be appreciated that the ejector mechanism is optional and in addition, the illustrated ejector mechanism is merely exemplary and not limiting of the scope of scope mechanism and the scope of the present invention.

In accordance with the present invention, the apparatus 100 is a stand-alone unit that is designed to rapidly freeze (e.g., in less than 1 minute (e.g., 45 seconds or 30 seconds or below) the freezable liquid as a result of the use of freeze block 310 which is pre-chilled to temperatures well below the freezing point of the freezable liquid (e.g., temperatures down to about −50.0° F. and preferably temperatures below 0° F. and from about 0° F. to about −30.0° F., such as −10° F. to −30° F.). It will be appreciated that the specific temperature varies depending upon a number of factors including the freezing point of the liquid to be frozen, the target freezing time period (i.e., how quick you want to the liquid to freeze), the volume of liquid to be frozen, etc.

In accordance with the present invention, the method and apparatus provide for the making of an iced beverage, the iced beverage may include a drink portion and a frozen portion. The drink portion and the frozen portion may comprise the same formula or concentration of various ingredients. The drink portion may be in liquid form, while the frozen portion may be ice in form, such as ice cubes of different shapes, including cubes, crescents, toroids, etc. The frozen portion may be made from the same liquid formula as the drink portion, but be frozen, i.e., ice. As a result, as the flavored ice cubes, once in the drink portion, melt in a drinking container over time as a person drinks the iced beverage, the drink portion in liquid form may not become diluted—as may be the case if the ice cubes were made from a liquid formula different from that of the drink portion, such as being made of ordinary tap water or other non-flavored water.

The ice making apparatus 200 can make flavored ice cubes out of a flavored, liquid formula. The flavored, liquid formula may have a color associated with it other than the clear "color" of tap or bottled water. The flavored, liquid formula may be a water-based liquid, but with flavoring and/or coloring, such as coffee, tea, orange juice, tomato juice, fruit juice, vegetable juice, lemonade, soda, milk, chocolate milk, and/or other colored liquids. In one embodiment, the flavored, liquid formula may be coffee, and have a uniform brown, black, cream, milk, or other color throughout.

It will also be appreciated that the freezable liquid that is introduced into the freeze block can be an alcohol based liquid. As is known, many alcohol based drinks are not pure alcohol but include other components, such as juices, etc. The freezing point of ethanol alcohol is substantially below other water; however, in general, hard liquor has freezing points that are not as low as pure ethanol. For example, 24 proof liquor freezes at about −6.7° C. (20° F.); 64 proof liquor freezes at about −23.33° C. (−10° F.); and 84 proof liquor freezes at about −34.44° C. (−30° F.). The addition of other liquids, such as juices, will raise the freezing point. For example, a mixture of vodka and cranberry juice and grapefruit juice, which is commonly known as a vodka sea breeze, can be added to the cells (wells) 320 to produce frozen masses that include alcohol. In addition, unmixed liquor can be added directly to the cells 320.

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. An apparatus for rapidly freezing a freezable liquid to form at least one frozen object comprising:

a fluid intake in which the freezable liquid is introduced;

a freeze chamber that receives the freezable liquid from the fluid intake and includes a freeze block that includes at least one cell in which one frozen object is formed; and a cooling system that includes a compressor and refrigerant which is circulated through the cooling system to the freeze block which includes a coil formed therethrough to facilitate cooling of the freeze block;

wherein the freeze block is formed of a heat transfer material such that heat from the freezable liquid added to the at least one cell is transferred to the freeze block whereupon said heat is transferred to the refrigerant flowing through the evaporator coil of the freeze block, thereby resulting in cooling of the freeze block;

wherein the freeze block is configured and the refrigerant is selected such that the freeze chamber is maintained at a temperature of 0° F. or below;

wherein the fluid intake comprises a fluid dispenser that has an inlet that receives the freezable liquid and a dispenser manifold that is in fluid communication with the fluid dispenser and includes an integral channel architecture that allows the freezable liquid to flow to each cell for filling thereof; and wherein the dispenser and dispenser manifold are fixedly attached to one another and to the apparatus and are movable relative to the freeze chamber between an in-use position in which the dispenser and dispenser manifold are positioned above the freeze chamber and a storage position in which the dispenser and dispenser manifold are disposed on a side of the apparatus and remain fixedly attached to the apparatus.

2. The apparatus of claim 1, wherein the heat transfer material comprises aluminum.

3. The apparatus of claim 1, wherein the apparatus is a portable unit that is configured and sized to rest on a table top.

4. The apparatus of claim 3, wherein the apparatus has a length of less than about 36 inches; a width of less than 20 inches and a height of less than about 18 inches.

5. The apparatus of claim 1, wherein the freeze block comprises an aluminum block that has a plurality of open cells formed in an upper surface thereof, the coil being an evaporator coil being disposed within the block about the cells.

6. The apparatus of claim 1, wherein the refrigerant comprises an HFC-404A refrigerant.

7. The apparatus of claim 1, wherein the fluid dispenser comprises a trough with a plurality of openings formed along a bottom thereof and the dispenser manifold includes a plurality of channel inlets that are in fluid communication with the respective openings of the trough and a plurality channel outlets that are in fluid communication with a plurality of cells formed in the freeze block.

8. The apparatus of claim 1, further including a chute that receives the frozen object and a cup holder that receives a single cup and positions it adjacent the chute for receiving the frozen object.

9. The apparatus of claim 1, wherein the frozen object comprises a plurality of ice cubes.

10. The apparatus of claim 1, wherein the freeze block includes a plurality of temperature sensors for monitoring a temperature of the freeze block at different locations thereof.

11. The apparatus of claim 10, wherein the temperature sensors comprise thermocouple devices.

12. The apparatus of claim 1, further including a freeze chamber cover that is movable between an open position and a closed position in which the freeze chamber is sealed.

13. An apparatus for rapidly freezing a freezable liquid to form at least one frozen object comprising:

a fluid intake in which the freezable liquid is introduced;

a freeze chamber that receives the freezable liquid from the fluid intake and includes a freeze block that includes at least one cell in which one frozen object is formed;

a freeze chamber cover that is movable between an open position and a closed position in which the freeze chamber is sealed; and a cooling system that includes a compressor and refrigerant which is circulated through the cooling system to the freeze block which includes a coil formed therethrough to facilitate cooling of the freeze block;

wherein the freeze block is formed of a heat transfer material such that heat from the freezable liquid added to the at least one cell is transferred to the freeze block whereupon said heat is transferred to the refrigerant flowing through the evaporator coil of the freeze block, thereby resulting in cooling of the freeze block;

wherein the freeze block is configured and the refrigerant is selected such that the freeze chamber is maintained at a temperature of 0° F. or below, and wherein the freeze chamber cover carries a mechanism for removing the frozen object from the at least one cell.

14. An apparatus for rapidly freezing a freezable liquid to form at least one frozen object comprising:

a fluid intake in which the freezable liquid is introduced;

a freeze chamber that receives the freezable liquid from the fluid intake and includes a freeze block that includes at least one cell in which one frozen object is formed; and a cooling system that includes a compressor and refrigerant which is circulated through the cooling system to the freeze block which includes a coil formed therethrough to facilitate cooling of the freeze block; and an ejector mechanism for ejecting the frozen object from the at least one cell, the ejector mechanism being mounted below the freeze block and including a plurality of pins that are each at least partially insertable upwards through sealable openings formed along a floor of the at least one cell, wherein insertion of the pins through the sealed openings causes dislodgement of the frozen object from the at least one cell;

wherein the freeze block is formed of a heat transfer material such that heat from the freezable liquid added to the at least one cell is transferred to the freeze block whereupon said heat is transferred to the refrigerant flowing through the evaporator coil of the freeze block, thereby resulting in cooling of the freeze block; and wherein the freeze block is configured and the refrigerant is selected such that the freeze chamber is maintained at a temperature of 0° F. or below.

15. The apparatus of claim 1, wherein the freeze block comprises a heater that includes a plurality of heater elements disposed within the freeze block for controllably heating the at least one cell to assist in removal of the frozen object.

16. The apparatus of claim 1, wherein the frozen object is formed within about 1 minute of injecting the freezable liquid into the cell.

17. The apparatus of claim 1, wherein the freeze block includes a plurality of cells that hold ice having a total mass between about 20 grams and about 210 grams.

18. A portable ice making apparatus for rapidly freezing a freezable liquid to form ice comprising:

a fluid intake in which the freezable liquid is introduced is into an inlet and passes through a manifold which divides the freezable liquid into plural flow paths;

a freeze chamber that receives the freezable liquid from the plural flow paths of the fluid intake and includes a freeze block that includes a plurality of cells in which ice is formed, the flow paths being in fluid communication with the plurality of cells; and a cooling system that includes a compressor, a condenser and refrigerant which is circulated through the cooling system to the freeze block which includes an evaporator coil formed below and in between the plurality of cells to facilitate cooling of the freeze block;

an ejector mechanism positioned below the freeze chamber and the evaporator coil, the ejector mechanism being configured to cause dislodgement of the ice from the plurality cells in an upward direction relative to the freeze block;

wherein the freeze chamber, the cooling system, and the ejector mechanism form a common subassembly, and the ejector mechanism is positioned to dislodge the ice without interfering with the evaporate coil; and wherein the freeze block is configured and the refrigerant is selected such that the freeze chamber is maintained at a temperature of 0° F. or below.

* * * * *